US006341735B1

(12) United States Patent
Baudin

(10) Patent No.: US 6,341,735 B1
(45) Date of Patent: Jan. 29, 2002

(54) RECEPTACLE FITTED WITH A DISPENSER HEAD

(75) Inventor: Gilles Baudin, Domont (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/563,500

(22) Filed: May 3, 2000

(30) Foreign Application Priority Data

May 5, 1999 (FR) ..... 99 05695

(51) Int. Cl.[7] ..... A62C 11/00
(52) U.S. Cl. ..... 239/333; 239/602; 137/845
(58) Field of Search ..... 239/333, 337, 239/546, 602, 463, 464, 568, 533.1, 533.13, DIG. 12; 222/490, 491, 494, 495, 80, 402.1, 402.13; 137/845

(56) References Cited

U.S. PATENT DOCUMENTS 1,636,314 A 7/1927 Murray
3,250,474 A 5/1966 McKernan
4,884,750 A 12/1989 Werding
5,186,368 A 2/1993 Garcia
5,738,282 A * 4/1998 Grogan ..... 239/333

FOREIGN PATENT DOCUMENTS

FR 2 284 533 A 4/1976
FR 2 708 908 A 2/1995

* cited by examiner

*Primary Examiner*—Lisa Ann Douglas
(74) *Attorney, Agent, or Firm*—Oliff & Berridge, PLC

(57) ABSTRACT

A receptacle is fitted with a dispenser head which includes a body and a nozzle secured to the body. The nozzle is provided with a dispenser orifice, made through an elastically deformable wall organized to bulge outwards under the effect of the pressure of a substance. The nozzle is closed at rest and is opened by deformation of the elastically deformable wall under the effect of the pressure of the substance being dispensed.

23 Claims, 2 Drawing Sheets

RECEPTACLE FITTED WITH A DISPENSER HEAD

The present invention relates to receptacle fitted with a dispenser head comprising a body and a dispenser nozzle secured to said body, said nozzle being provided with a dispenser orifice, e.g. for spraying a substance.

BACKGROUND OF THE INVENTION

Numerous dispenser heads of this type are known.

When the sprayed substance forms a solid deposit on drying, the dispenser orifice tends to become clogged.

U.S. Pat. No. 3,250,474 proposes mounting the nozzle movably on the body of the dispenser head, and forming a spike on said body for the purpose of closing the dispenser orifice when the dispenser head is not in use.

This reduces the risk of the dispenser orifice being clogged by a residue of dried substance.

However, the dispenser head described in that prior patent is relatively complex in structure.

Further, for manufacturing reasons, the end of the spike and the dispenser orifice can be made only with relatively large sections, and as a result that known dispenser head is poorly adapted to spraying a substance at a low rate.

OBJECTS AND SUMMARY OF THE INVENTION

An object of the invention is to remedy some of the drawbacks of known dispenser heads.

The invention seeks in particular to provide a novel receptacle fitted with a dispenser head which is relatively simple to manufacture and which makes it possible to reduce the risk of the dispenser orifice becoming clogged by a residue of substance that has dried.

In this novel receptacle, the dispenser orifice is made through an elastically deformable wall organized to bulge outwards under the effect of the pressure in the substance and said orifice is organized in such a manner as to be closed at rest and to be capable of being opened by said wall deforming under the effect of the pressure of substance upstream while substance is being dispensed.

By means of the invention, a dispenser head is made available that is relatively simple to manufacture, and in which the dispenser orifice is closed at rest so that the substance contained in the dispenser head is prevented from drying out.

In a particular embodiment, the dispenser orifice is made by piercing the elastically deformable wall, but without removing material therefrom.

This makes it possible to provide a dispenser orifice which provides a very small flow section to the substance while dispensing, thereby enabling the substance to be dispensed at a relatively low rate.

In a particular embodiment, the elastically deformable wall is organized to deform other than at the dispenser orifice under the effect of the pressure of the substance while it is being dispensed.

This deformation of the elastically deformable wall favors detachment of any residue of substance that might be adhering to the surface thereof.

This further reduces the risk of the dispenser orifice becoming clogged and the nozzle is maintained in a suitably clean state.

In a particular embodiment, the elastically deformable head is constituted by an elastomer disk.

The disk may be held at its periphery to a ring made of a rigid plastics material.

The disk may have a rib on its inside face, the rib being inserted in a groove of complementary shape formed in the ring.

In a particular embodiment, said elastically deformable wall bears at rest against the front face of a center post belonging to the body of the dispenser head.

Swirling channels may be formed in the front face of the center post, in order to confer particular characteristics to the flow passing through the dispenser orifice.

In a particular embodiment, an annular gap is formed around the center post for feeding the above-specified swirling channels.

In a particular embodiment, the nozzle is fixed in a housing of the body of the dispenser head, and the opening of the housing presents a narrowing of section.

In a particular embodiment, the body of the dispenser head includes an endpiece for mounting on the control rod of a valve or a pump.

The axis of the dispenser orifice may be perpendicular to the axis of the endpiece.

BRIEF DESCRIPTION OF THE DRAWINGS

Other characteristics and advantages of the present invention will appear on reading the following detailed description of a non-limiting embodiment of the invention, and on examining the accompanying drawings, in which.

MORE DETAILED DESCRIPTION

Figure 1:
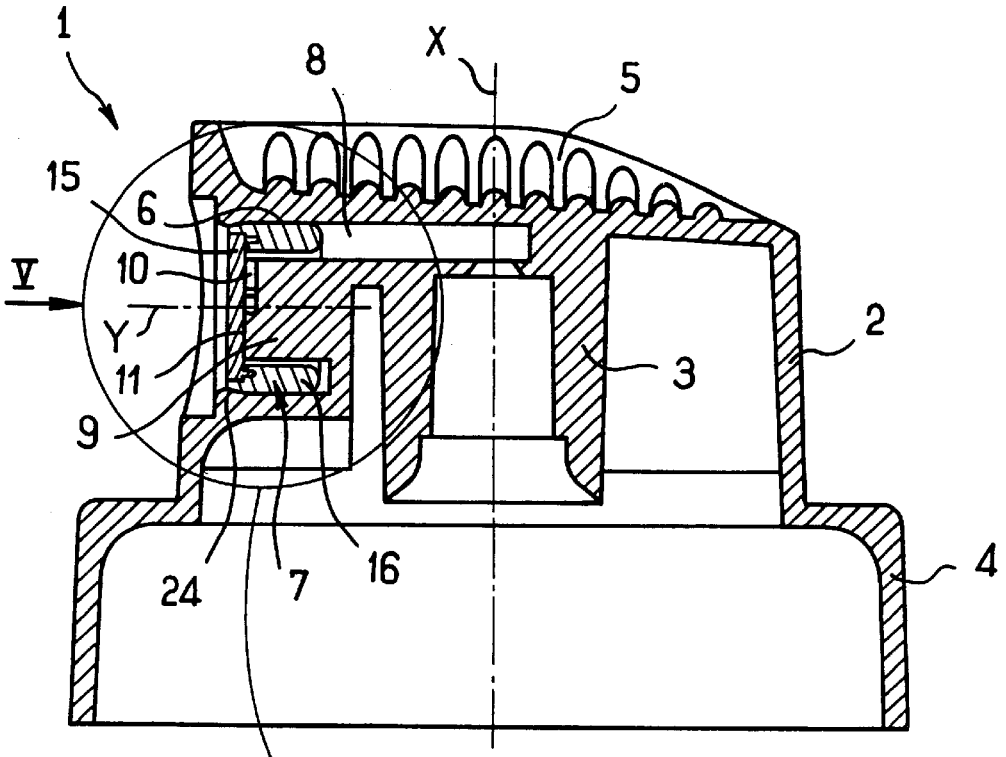
FIG. 1 is a diagrammatic view in axial section of a dispenser head in accordance with the invention.

The dispenser head 1 shown in FIG. 1 comprises a body 2 molded out of plastics material, preferably a rigid plastics material.

The body 2 has a downwardly open endpiece 3 about an axis X for mounting the dispenser head on the control rod (not shown) of a valve or a pump fitted to a receptacle containing a liquid, e.g. hair spray.

When the receptacle is fitted with a valve, it may contain a propellant gas under pressure.

The control rod is designed to be received as a force-fit in the endpiece 3 and it includes a channel for feeding substance.

The body 2 has an outer skirt 4 to improve the appearance of the receptacle on which the dispenser head is mounted.

A indentation 5 is formed in the top face of the body 2 to receive the finger of a user pressing down the dispenser head 1 for the purpose of dispensing the substance.

Figure 4:
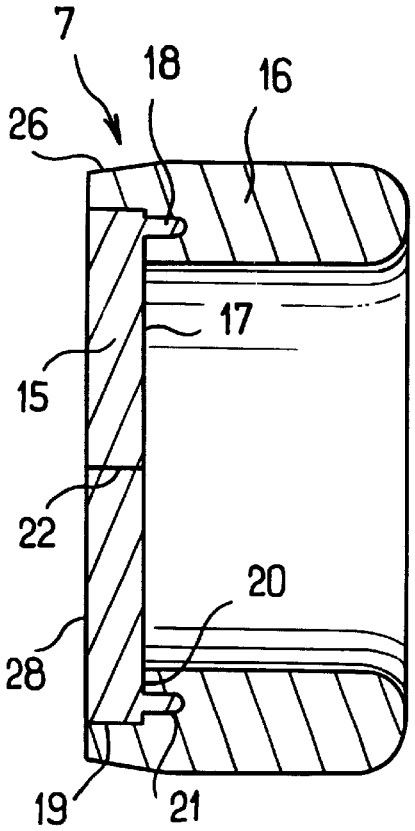
FIG. 4 is an axial section showing the nozzle on its own, prior to being mounted on the body of the dispenser head.

The body 2 has a housing 6 on an axis Y perpendicular to the axis X for receiving a nozzle 7 that is shown on its own in FIG. 4.

This housing 6 is open to the front face of the body 2, and it communicates via a channel 8 with the end of the endpiece 3.

A center post 9 on the axis Y extends inside the housing 6.

Figure 5:
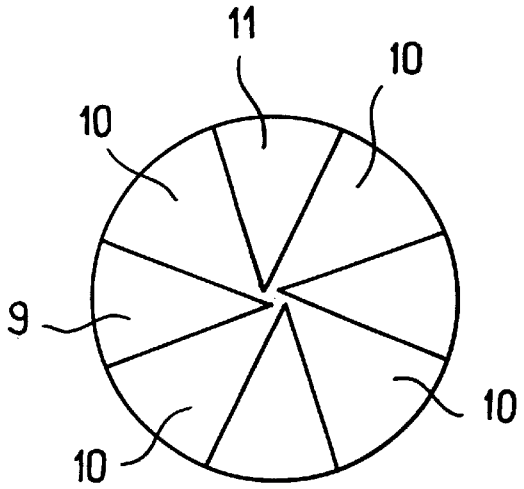
FIG. 5 is a front view of the center post as seen looking along arrow V of FIG. 1.

Swirling channels 10 are made in the front face 11 of the center post 9, as can be seen in FIG. 5, so as to create a flow that swirls around the axis Y, in conventional manner.

The nozzle 7 comprises a disk 15 made of an elastomer material, e.g. a thermoplastic elastomer known under the trade name Santoprene, which is secured in leakproof manner at its periphery to a mounting ring 16 made of a non-elastomer plastics material.

On its inside face 17, in the vicinity of its periphery, the disk 15 has an annular rib 18 and the mounting ring has a circularly cylindrical setback 19 in its front face corresponding to the diameter of the disk 15, with the inside face 17 of the disk bearing against the end wall 20 of said setback 19.

In the end 20 of the setback 19, the ring 16 has an annular groove 21 into which the annular rib 18 is inserted.

The disk 15 is pierced in its center by an orifice 22.

The orifice 22 is made by piercing the disk 15 without removing material therefrom, so that at rest it is closed because of the elasticity of the elastomer material from which the disk 15 is made.

The opening of the housing 6 in the body 2 of the dispenser head has an annular rim 24 defining a narrowing in section, and the ring 16 is put into place by being snap-fastened in the housing 6.

During assembly of the nozzle 7, the ring 16 and the body 2 deform elastically to enable the ring 16 to move past the annular rim 24.

Figure 2:
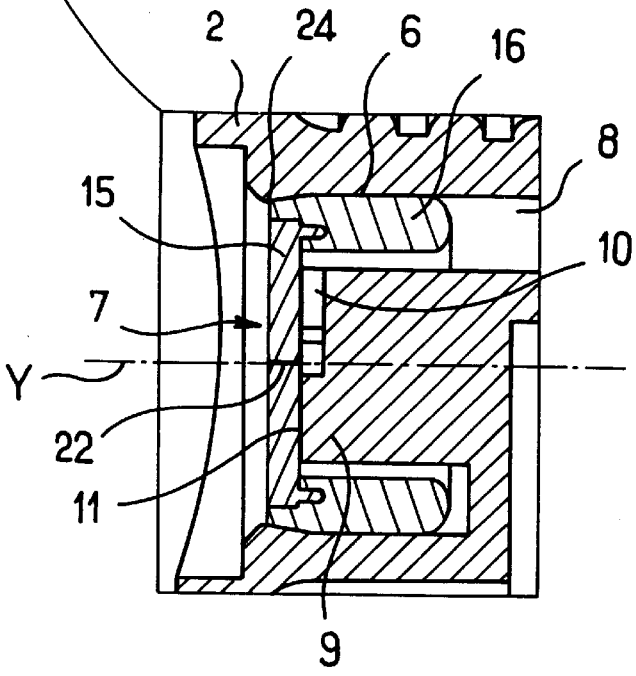
FIG. 2 shows an implementation detail of FIG. 1.

When the nozzle 7 is in place, the inside face 17 of the disk 15 bears against the front face 11 of the central post 9, as can be seen in FIG. 2.

At its front end and its periphery, the ring 16 presents a conical surface 26 which bears against the rear flank of the annular rim 24, as can be seen in FIG. 2.

The ring 16 is thus held in leakproof manner in the housing 6.

To dispense the substance, the user presses on the top face of the dispenser head 1, thereby pushing down the control rod and causing substance under pressure to penetrate into the channel 8 and the annular groove 27 formed between the center post 9 and the ring 16.

This substance under pressure reaches the swirling channels 10.

The disk 15 bulges outwards under the effect of the pressure of the substance acting on its inside face 17.

The deformation of the disk 15 makes it possible to detach any residue of dried substance that might be adhering to its outside face 28, that become convex towards the outside.

Figure 3:
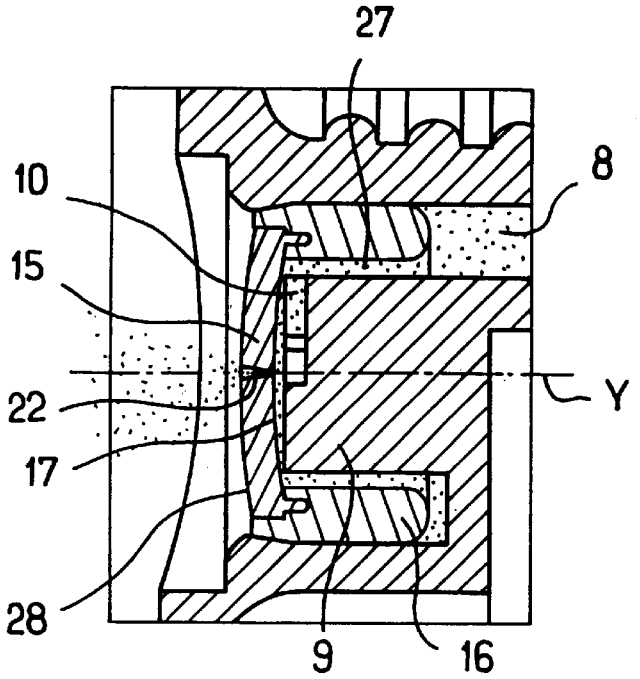
FIG. 3 is a view analogous to FIG. 2, showing the nozzle at the moment when substance is being dispensed.

In addition, the bulging of the disk 15 tends to open the dispenser orifice 22 which then offers an outwardly-flaring and substantially circular section to the flow of the substance, as can be seen in FIG. 3.

The disk 15 deforms sufficiently to enable the substance to be ejected through the orifice 22 and be dispensed, e.g. in the form of a conical spray.

It will be observed that the section offered to flow of the substance by the orifice 22 remains very small, thus making it possible to dispense the substance at a low rate.

When the user releases the dispenser head 1, the channel 8 ceases to be fed, and the disk 15 tends to return to its initial configuration in which the outside face 28 is substantially plane and perpendicular to the axis Y, and in which the orifice 22 is closed.

By closing the orifice 22, the inside of the dispenser head is isolated from ambient air, thereby preventing the substance therein from drying out.

Naturally, the invention is not limited to the embodiment described above.

In particular, the shape of the substance feed channels upstream from the dispenser orifice can be modified as a function of the droplet size characteristics desired for the aerosol that is sprayed.

It is also possible to modify the shape of the dispenser orifice depending on the nature of the substance and on the flow characteristics that are desired.

It is also possible to make channels inside the nozzle.

The dispenser head can have two or more nozzles.

What is claimed is:

1. A receptacle fitted with a dispenser head comprising:

a body; and a nozzle secured to said body, wherein the nozzle includes a mounting ring made of a rigid plastic material and an elastically deformable wall, said wall being attached at its periphery to the mounting ring, said wall having a dispenser orifice, wherein said wall bulges outwards under an effect of a pressure of a substance upstream while the substance is being dispensed.

2. A receptacle according to claim 1, wherein the dispenser orifice is made by piercing the elastically deformable wall, but without removing material therefrom.

3. A receptacle according to claim 1, wherein the elastically deformable wall is organized to deform other than at the dispenser orifice under the effect of the pressure of the substance while it is being dispensed.

4. A receptacle according to claim 1, wherein the elastically deformable wall is constituted by an elastomer disk.

5. A receptacle according to claim 4, wherein the disk has an inside face, the inside face having a rib and the mounting ring having a groove; the groove having a slope that is complementary to the shape of the rib.

6. A receptacle according to claim 1, wherein the body of the dispenser head includes an endpiece for mounting on a control rod of a valve or a pump.

7. A receptacle according to claim 6, wherein said dispenser orifice has an axis, wherein the endpiece has an axis and wherein the axis of the dispenser orifice is perpendicular to the axis of the endpiece.

8. A receptacle according to claim 1, wherein the receptacle contains a substance forming a solid deposit on drying.

9. A receptacle according to claim 1, wherein said orifice closes when said wall is at rest and opens when said wall bulges under the effect of the pressure of the substance upstream while the substance is being dispensed.

10. A receptacle fitted with a dispenser head comprising:

a body;

a center post having a front face; and a nozzle secured to the body, said nozzle including an elastically deformable wall, said wall having a dispenser orifice, said wall deforming under an effect of a pressure of a substance upstream while the substance is being dispensed.

11. A receptacle according to claim 10, wherein swirling channels are formed in the front face of the center post.

12. A receptacle according to claim 11, wherein an annular gap is formed around the center post.

13. A receptacle according to claim 10, therein said orifice closes when said wall is at rest and opens when said wall bulges under the effect of the pressure of the substance upstream, and wherein said wall bears against the front face when said wall is at rest.

14. A receptacle fitted with a dispenser head comprising:

a body, the body having a housing; and a nozzle secured to said body, wherein the nozzle includes an elastically deformable wall, said wall having a dispenser orifice, wherein said wall deforms under an effect of a pressure of a substance upstream while the substance is being dispensed, wherein said housing has an opening, said opening having a portion that narrows in a direction of a flow of the substance dispensed through the dispenser orifice, said nozzle being fixed in said opening.

15. A receptacle according to claim 14, wherein said orifice closes when said wall is at rest and opens when said wall bulges under the effect of the pressure of the substance upstream.

16. A receptacle filled with a substance and fitted with a dispenser head comprising a body and a nozzle secured to said body, the nozzle being provided with a dispenser orifice, wherein said dispenser orifice is made through an elastically deformable wall and wherein said orifice is organized in such a manner as to be closed at rest and to be capable of being opened by said wall deforming under an effect of a pressure of the substance upstream while the substance is being dispensed, said substance forming a deposit on drying.

17. A receptacle filled with a substance and fitted with a spray head comprising a body and a spray nozzle secured to said body, said spray nozzle being provided with a spray orifice, wherein said spray orifice is made through an elastically deformable wall and wherein said orifice is organized in such a manner as to be closed at rest and to be capable of being opened by said wall bulging under an effect of a pressure of the substance upstream while the substance is being dispensed, said substance forming a deposit on drying.

18. A receptacle fitted with a dispenser head comprising:

a nozzle, the nozzle including an elastically deformable wall, said wall having a dispenser orifice through the thickness of said wall; and a center post, the center post having a front face, the front face having swirling channels, wherein said elastically deformable wall deforms under an effect of a pressure of a substance while the substance is being dispensed and said wall bears at rest against the front face of said center post.

19. A receptacle fitted with a dispenser head comprising:

a nozzle, said nozzle having an elastically deformable wall, said wall having a dispenser orifice, said wall deforming under an effect of a pressure of a substance while said substance is being dispensed; and swirling channels.

20. A receptacle fitted with a dispenser head comprising:

a body; and a nozzle secured to said body, the nozzle including an elastically deformable wall, said wall having a dispenser orifice, said wall bulging outwards under an effect of a pressure of a substance, said nozzle comprising a passage in communication with said dispenser orifice, said passage having a portion which does not contain an axis (Y) of said orifice and which is oriented in a direction parallel to said axis (Y).

21. A receptacle according to claim 20, wherein said orifice is organized in such a manner as to be closed at rest and to be capable of being opened by said wall deforming under the effect of the pressure of the substance upstream while the substance is being dispensed.

22. A receptacle fitted with a dispenser head comprising:

a body; and a nozzle secured to said body, the nozzle including an elastically deformable wall, said wall having a dispenser orifice, wherein said nozzle is formed of two different materials.

23. A receptacle according to claim 22, wherein said wall bulges outwards under an effect of a pressure of a substance and said orifice closes at rest and opens by said wall deforming under the effect of the pressure of the substance upstream while the substance is being dispensed.

* * * * *